US011536108B2

(12) United States Patent
Emmett

(10) Patent No.: US 11,536,108 B2
(45) Date of Patent: Dec. 27, 2022

(54) WELLHEAD TORQUE RING

(71) Applicant: CACTUS WELLHEAD, LLC, Houston, TX (US)

(72) Inventor: Jacob C. Emmett, Houston, TX (US)

(73) Assignee: CACTUS WELLHEAD, LLC, Houston, TX (US)

( * ) Notice: Subject to any disclaimer, the term of this patent is extended or adjusted under 35 U.S.C. 154(b) by 42 days.

(21) Appl. No.: 17/137,621

(22) Filed: Dec. 30, 2020

(65) Prior Publication Data

US 2021/0198971 A1 Jul. 1, 2021

Related U.S. Application Data

(60) Provisional application No. 62/955,974, filed on Dec. 31, 2019.

(51) Int. Cl.
*E21B 33/04* (2006.01)
*E21B 33/08* (2006.01)

(52) U.S. Cl.
CPC ..... *E21B 33/0415* (2013.01); *E21B 33/085* (2013.01)

(58) Field of Classification Search
CPC ..... E21B 33/0415; E21B 33/085
See application file for complete search history.

(56) References Cited

U.S. PATENT DOCUMENTS

| | | | | |
|---|---|---|---|---|
| 4,408,783 | A * | 10/1983 | Gruller | E21B 33/043 285/321 |
| 9,506,329 | B2 * | 11/2016 | Massey | E21B 33/0415 |
| 10,233,714 | B2 * | 3/2019 | Cheah | E21B 23/02 |
| 10,648,243 | B1 * | 5/2020 | Burrows | E21B 17/046 |
| 2018/0258727 | A1 * | 9/2018 | Lim | E21B 23/01 |

* cited by examiner

*Primary Examiner* — Aaron L Lembo
(74) *Attorney, Agent, or Firm* — Ewing & Jones, PLLC

(57) ABSTRACT

A wellhead assembly includes a wellhead housing; a tubing hanger, plug, back pressure valve, two-way check valve, BOP test plug, temporary abandonment plug, or other device; and a torque ring. The wellhead housing includes an inner bore. The wellhead housing has one or more mating grooves formed on an inner wall of the wellhead housing. The tubing hanger, plug, back pressure valve, two-way check valve, BOP test plug, temporary abandonment plug, or other device is positioned within the inner bore of the wellhead housing. The torque ring is positioned within a slot formed in the tubing hanger or other device. The torque ring includes a protrusion extending beyond the tubing hanger and into the mating groove.

17 Claims, 10 Drawing Sheets

WELLHEAD TORQUE RING

CROSS-REFERENCE TO RELATED APPLICATIONS

This application is a nonprovisional application which claims priority from U.S. provisional application No. 62/955,974, filed Dec. 31, 2019, the entirety of which is hereby incorporated by reference.

TECHNICAL FIELD/FIELD OF THE DISCLOSURE

The present disclosure relates to wellhead equipment and specifically to anti-rotation features for a wellhead assembly.

BACKGROUND OF THE DISCLOSURE

Typically, when retaining a tubing hanger, plug, or other similar device to a wellhead, one or more lock screws and alignment screws are used. The lock screws and alignment screws compress against the hanger or plug and both axially retain the hanger or plug to the wellhead but also reduce or prevent rotation of the hanger or plug relative to the wellhead housing. However, each such lock screw and alignment screw requires a hole to be formed in the wellhead housing and needs a sealing apparatus to isolate the production bore of the well from the external environment. Each hole formed in the wellhead housing presents a potential leak path, risking the possibility of the wellbore being exposed to the external environment.

SUMMARY

The present disclosure provides for a wellhead assembly. The wellhead assembly may include a wellhead housing having an inner bore. The wellhead housing may have one or more mating grooves formed on an inner wall of the wellhead housing. The wellhead assembly may include a tubing hanger positioned within the inner bore of the wellhead housing. The wellhead assembly may include a torque ring positioned within a slot formed in the tubing hanger. The torque ring may include a protrusion extending beyond the tubing hanger and into the mating groove.

The present disclosure also provides for a wellhead assembly. The wellhead assembly may include a wellhead housing having an inner bore. The wellhead housing may have one or more mating grooves formed on an inner wall of the wellhead housing. The wellhead assembly may include an alignment shoulder positioned within the inner bore of the wellhead housing. The wellhead assembly may include a torque ring positioned within a slot formed in the alignment shoulder. The torque ring may include a protrusion extending beyond the alignment shoulder and into the mating groove.

The present disclosure also provides for a method. The method may include providing a wellhead housing. The wellhead housing may include an inner bore and may have one or more mating grooves formed on an inner wall of the wellhead housing. The method may include positioning a torque ring into a slot formed in a tubing hanger, the torque ring including a protrusion extending beyond the tubing hanger. The method may include inserting the tubing hanger into the inner bore of the wellhead housing. The method may include engaging the wellhead housing with the protrusion. The method may include deflecting the torque ring inward until the protrusion is within the diameter of the inner bore of the wellhead housing. The method may include aligning the protrusion with the mating groove. The method may include biasing the protrusion radially outward into the mating groove. The method may include preventing rotation of the tubing hanger.

The present disclosure also provides for a method. The method may include providing a wellhead housing, the wellhead housing including an inner bore and having one or more mating grooves formed on an inner wall of the wellhead housing. The method may include positioning a torque ring into a slot formed in an alignment shoulder, the torque ring including a protrusion extending beyond the alignment shoulder. The method may include inserting the alignment shoulder into the inner bore of the wellhead housing. The method may include engaging the wellhead housing with the protrusion. The method may include deflecting the torque ring inward until the protrusion is within the diameter of the inner bore of the wellhead housing. The method may include aligning the protrusion with the mating groove. The method may include biasing the protrusion radially outward into the mating groove. The method may include preventing rotation of the alignment shoulder.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
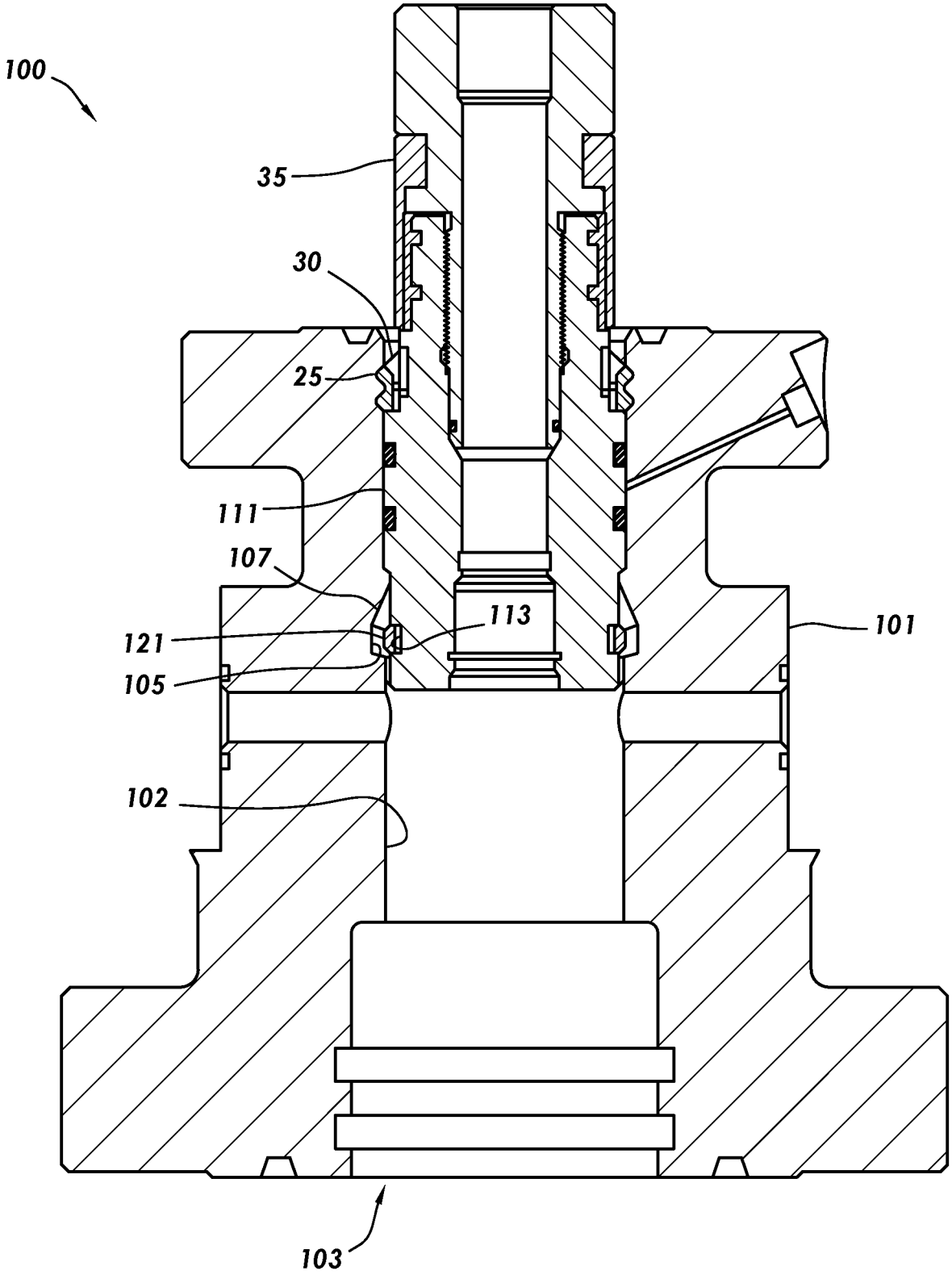
FIG. 1 depicts a cross section view of a wellhead assembly having a wellhead housing and tubing hanger and including an anti-rotation assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts wellhead assembly 100. Wellhead assembly 100 may include wellhead housing 101. Wellhead housing 101 may include inner bore 103 defined by inner wall 102 of wellhead housing 101. In some embodiments, wellhead assembly 100 may include tubing hanger 111. A tubing hanger, as used herein, refers to a device coupled to the upper end of a tubing string to support the tubing string in the wellbore. In some embodiments, tubing hanger 111 may be a snubbing hanger (a tubing hanger used when snubbing the tubing string into the wellbore against wellbore pressure), temporary hanger (a tubing hanger intended for temporary use as a hanger or as a plug), a flow bushing (a tubing hanger installed without suspended tubing and returns are produced up the previously installed casing string and through the hanger), or a tension hanger (a tubing hanger used to place the tubing string in tension). In some embodiments, although described as a tubing hanger, the component referred to herein as tubing hanger 111 may instead be a plug, back pressure valve, two-way check valve, BOP test plug, or temporary abandonment plug (a plug used to temporarily seal off a completed well) without deviating from the scope of this disclosure. Tubing hanger 111 may be generally tubular and may be installed to inner bore 103 of wellhead housing 101. In some embodiments, tubing hanger 111 may be retained to wellhead housing 101 by lock ring 25 and energizing ring 30. In some embodiments, lock ring 25 may be engaged to wellhead housing 101 to retain tubing hanger 111 to wellhead housing 101 by running tool 35. Running tool 35 may be a tool used to attach tubing hanger 111 to wellhead housing 101. In some embodiments, running tool 35 may thread onto tubing hanger 111 and, by rotation of running tool 35, drive energizing ring 30 between tubing hanger 111 and lock ring 25 until lock ring 25 is in engagement with wellhead housing 101. Energizing ring 30 may be generally wedge-shaped and positioned to move between tubing hanger 111 and lock ring 25 such that lock ring 25 is biased radially outward into engagement with wellhead housing 101. In other embodiments, lock ring 25 may engage wellhead housing 101 without the need for energizing ring 30 such as, for example, by spring-bias outward and may be wedged in place by an angle on the bottom of lock ring 25 that mates with tubing hanger 111.

Figure 2:
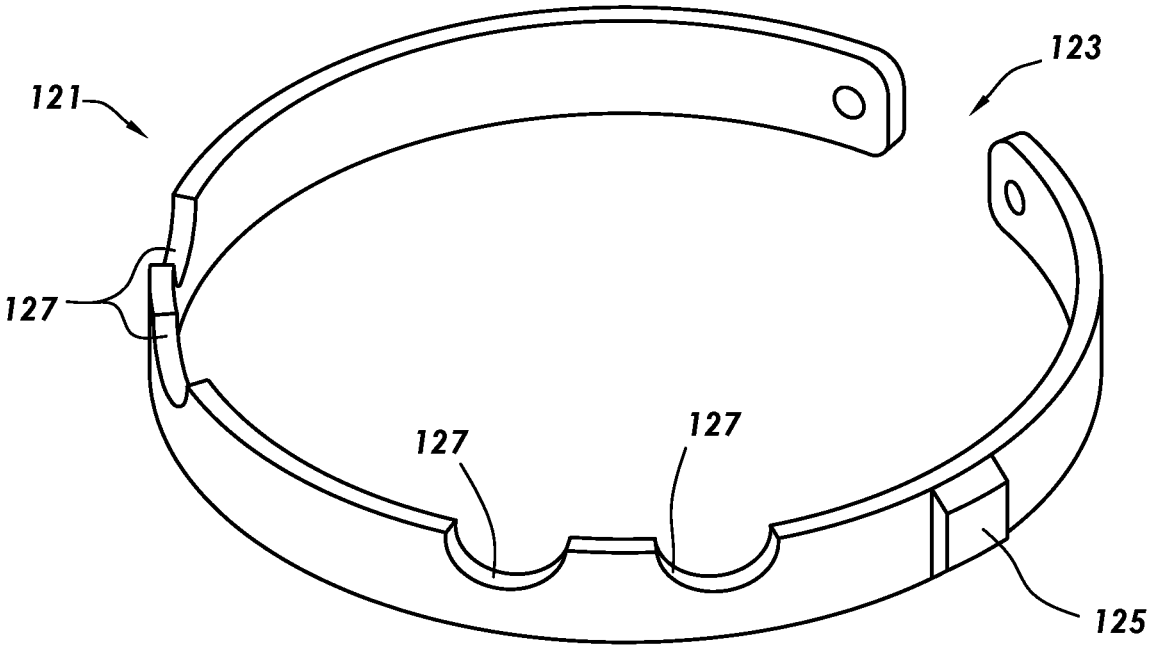
FIG. 2 depicts a perspective view of a torque ring consistent with at least one embodiment of the present disclosure.
Figure 2A:
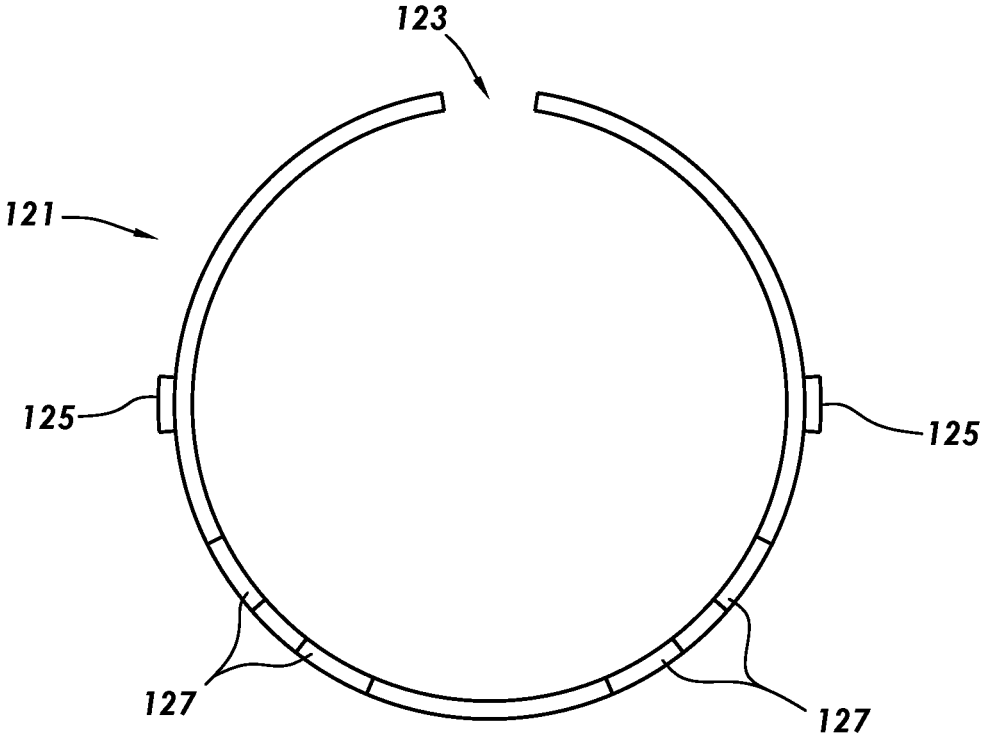
FIG. 2A depicts a top view of the torque ring of FIG. 2.

In some embodiments, wellhead assembly 100 may include torque ring 121. Torque ring 121 may be positioned within slot 113 formed in tubing hanger 111. In some embodiments, as shown in FIGS. 2, 2A, torque ring 121 may be formed as a split ring. Split 123 may, for example and without limitation, allow torque ring 121 to be installed to tubing hanger 111 and may provide space for torque ring 121 to be deformed inward as tubing hanger 111 is installed to wellhead housing 101 as further described herein below. In some embodiments, torque ring 121 may include one or more protrusions 125. Protrusions 125 may be formed in any shape such that protrusions 125 extend radially outward from the rest of torque ring 121. In some embodiments, torque ring 121 may include one or more torque transfer features 127. In some embodiments, as shown in FIGS. 2, 2A, torque transfer features 127 may include one or more castellations positioned to engage with tubing hanger 111 as further described below. Torque transfer features 127 may include, for example and without limitation, one or more semi-circular cutouts from torque ring 121.

Figure 3:
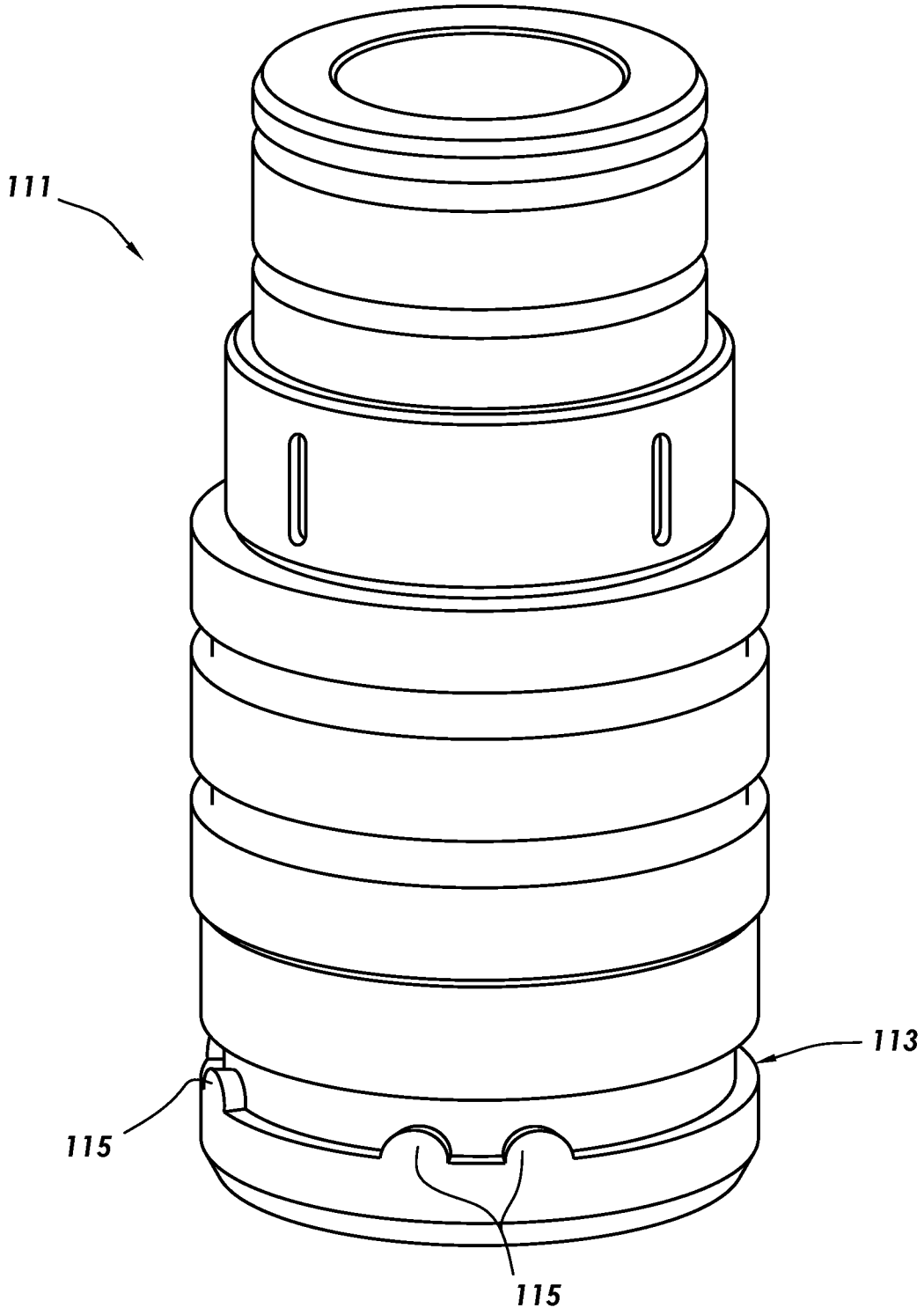
FIG. 3 depicts a perspective view of the tubing hanger of FIG. 1.
Figure 4:
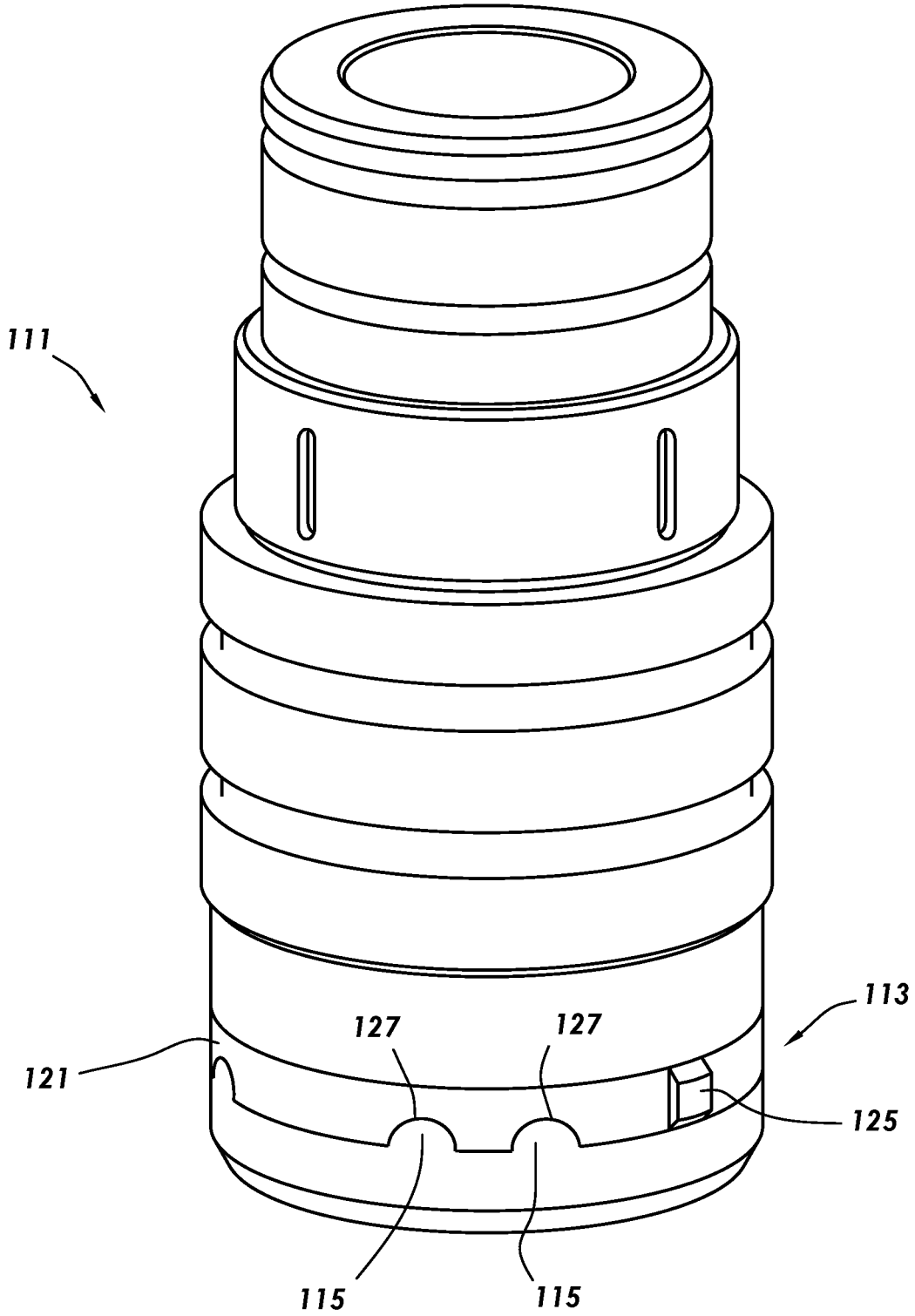
FIG. 4 depicts a perspective view of the tubing hanger of FIG. 3 with torque ring installed thereto.

In some embodiments, as depicted in FIG. 3, slot 113 formed in tubing hanger 111 may include one or more torque transfer features 115 that correspond with torque transfer features 127 of torque ring 121. For example and without limitation, in some embodiments, slot 113 may include one or more castellations or semi-circular extensions that engage with torque transfer features 127 of torque ring 121 as shown in FIG. 4 when torque ring 121 is installed to tubing hanger 111. Protrusions 125 may extend beyond the outer diameter of tubing hanger 111 when torque ring 121 is installed to tubing hanger 111. In some embodiments, the outer diameter of slot 113 may be less than the inner diameter of torque ring 121. In some such embodiments, the outer diameter of slot 113 may be less than the inner diameter of torque ring 121 by at least the length of protrusions 125.

Figure 5:
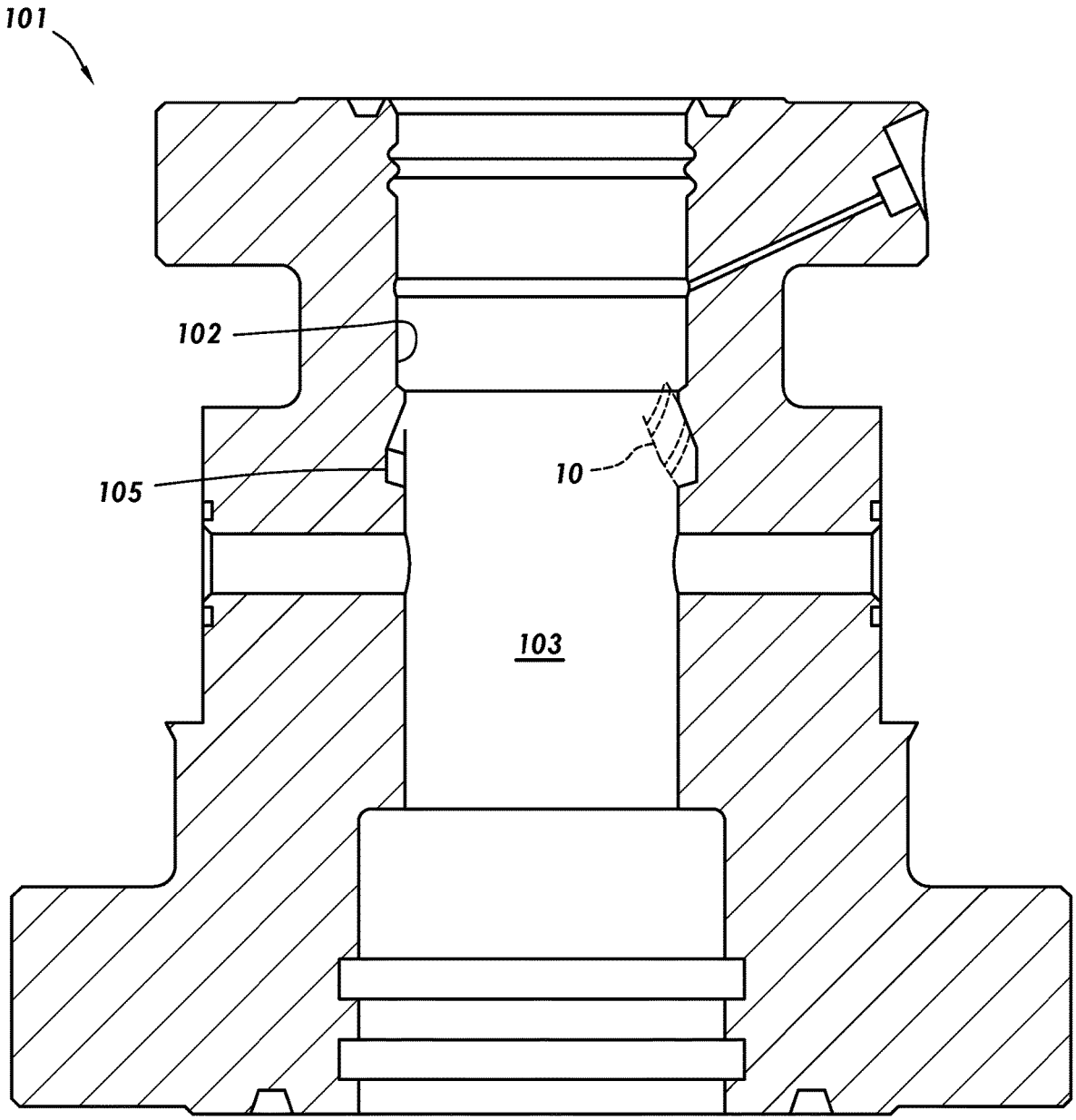
FIG. 5 depicts a cross-section view of the wellhead housing of FIG. 1.

In some embodiments, as shown in FIG. 5, wellhead housing 101 may include one or more mating grooves 105 formed on inner wall 102 of wellhead housing 101 positioned to correspond with the positions of protrusions 125 of torque ring 121 when tubing hanger 111 is fully installed to wellhead housing 101. In some embodiments, each mating grooves 105 may include one or more of cutouts, slots, indentations, or blind holes formed on inner wall 102 of wellhead housing 101. In some embodiments, mating grooves 105 may be formed by drilling at an angle from the open end of wellhead housing 101 as demonstrated by drill bit 10.

Figure 6:
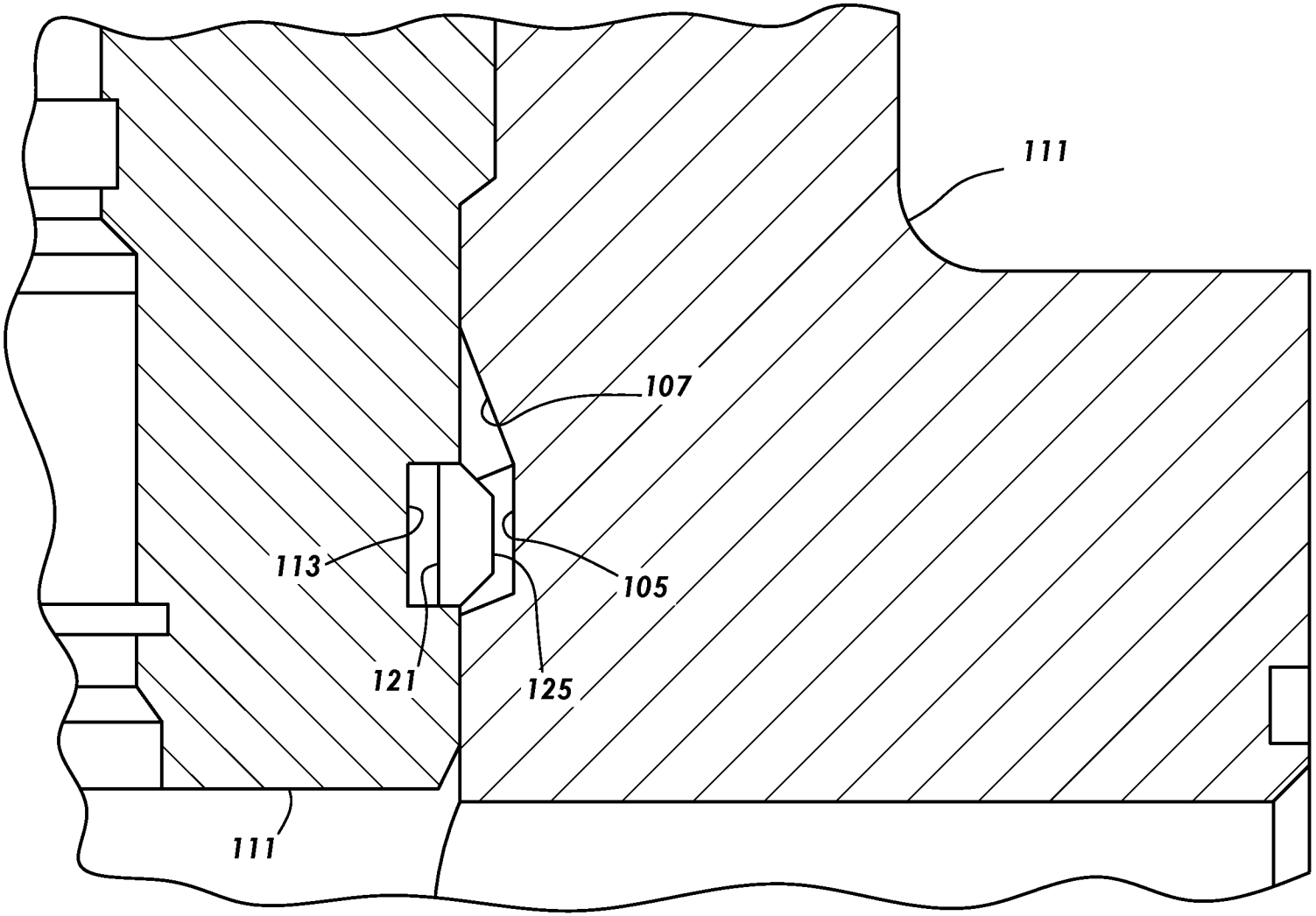
FIG. 6 depicts a detail cross section view of the wellhead assembly of FIG. 1.
Figure 7:
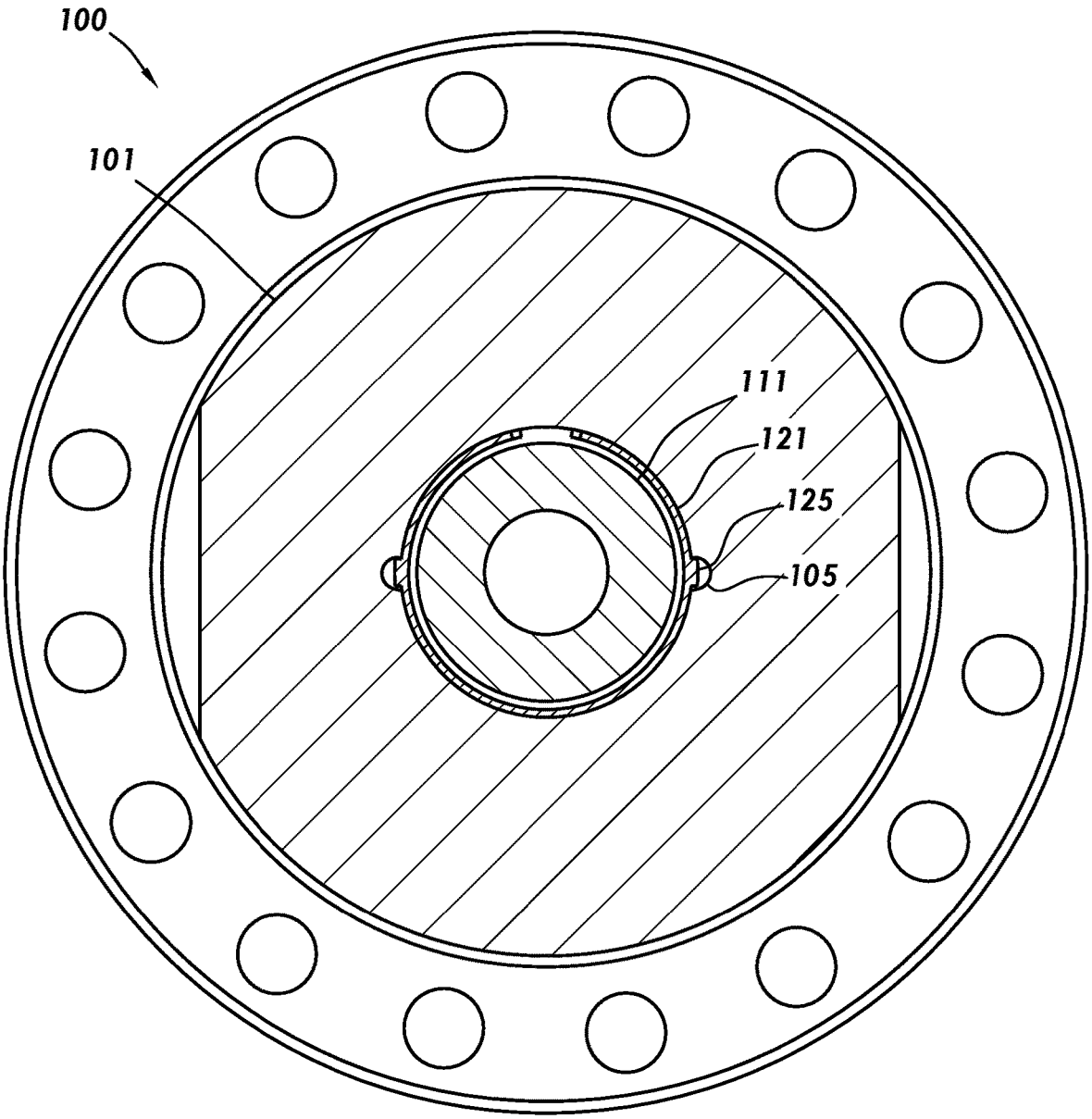
FIG. 7 depicts a cross section view of the wellhead assembly of FIG. 1.

In some embodiments, tubing hanger 111 is installed to wellhead housing 101 by inserting tubing hanger 111 into inner bore 103 of wellhead housing 101 as shown in FIG. 1. As torque ring 121 enters inner bore 103, protrusions 125 engage wellhead housing 101 and cause torque ring 121 to deflect inward against the spring bias of torque ring 121 until protrusions 125 are within the diameter of inner bore 103. Tubing hanger 111 continues to be inserted until protrusions 125 align with mating grooves 105 as shown in FIGS. 6 and 7. Protrusions 125 may be biased radially outward into mating grooves 105. Alternatively, tubing hanger 111 may be fully seated and then rotated until protrusions 125 come into alignment with mating grooves 105, at which time protrusions 125 are biased radially outward into mating grooves 105. Tubing hanger 111 may then be axially retained to wellhead housing 101 by lock ring 25 as described above. Tubing hanger 111 may therefore be axially and rotationally secured to wellhead housing 101 without adding requiring holes through wellhead housing 101.

Because protrusions 125 are positioned within mating grooves 105, rotation of tubing hanger 111 may be prevented or obstructed despite torque being applied to tubing hanger 111 including, for example and without limitation, torque caused by the use of running tool 35 or during the installation of backpressure valves, two-way check valves, plugs, or any other components. Torque applied to tubing hanger 111 is transferred to wellhead housing 101 through torque ring 121 via torque transfer features 115, 127 and protrusions 125.

In some embodiments, as shown in FIG. 6, mating grooves 105 may include tapered upper wall 107. Tapered upper wall 107 may, for example and without limitation, allow protrusions 125 to be biased radially inward as tubing hanger 111 is moved axially out of wellhead housing 101.

Figure 8:
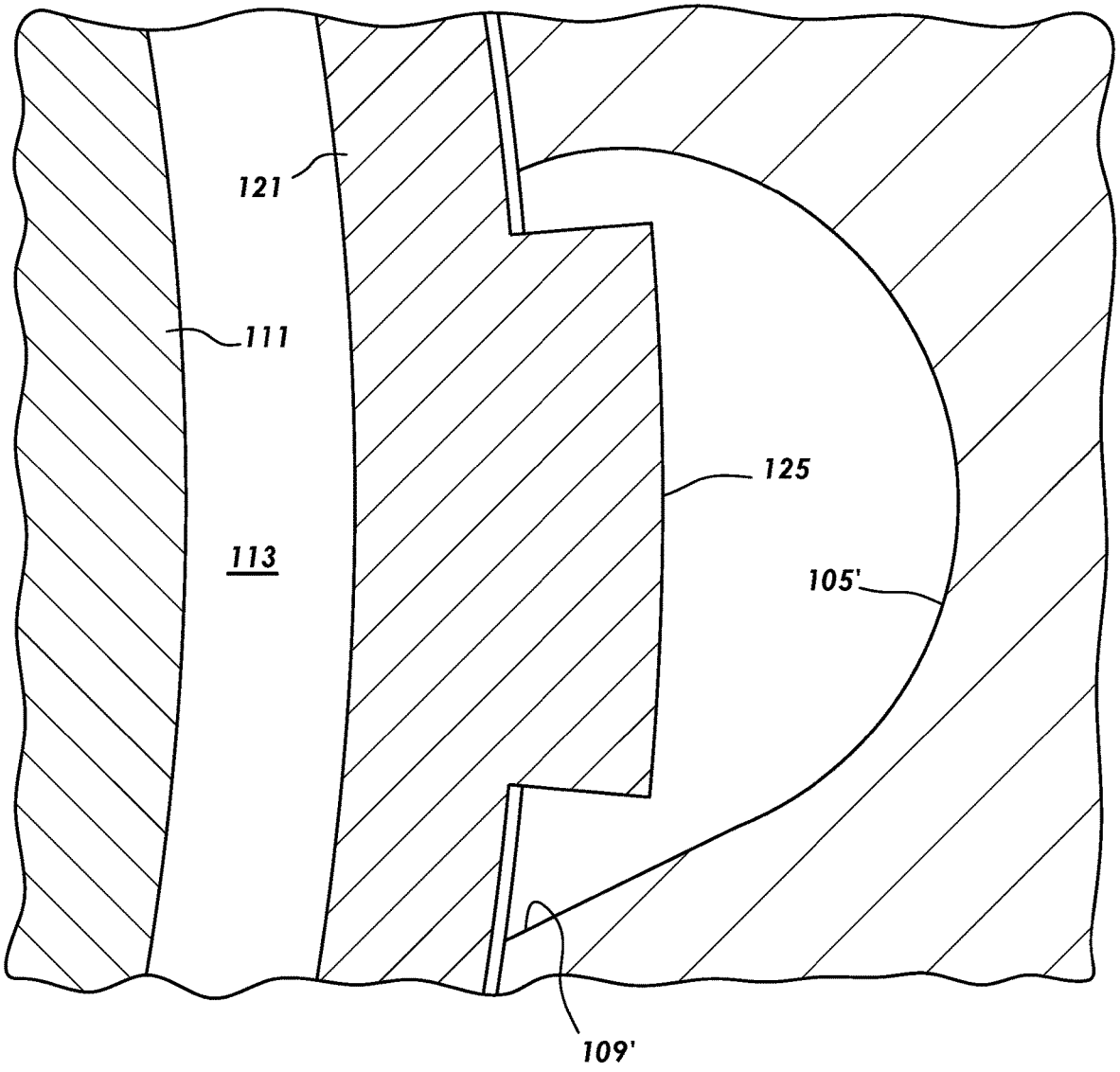
FIG. 8 depicts a cross section view of a wellhead assembly consistent with at least one embodiment of the present disclosure.

In some embodiments, as shown in FIG. 8, mating grooves 105' may include sidewall taper 109' such that a rotation of tubing hanger 111 such that protrusions 125 move toward sidewall taper 109' may allow protrusions 125 to be biased radially inward, thereby allowing tubing hanger 111 to be rotated in that direction while rotation of tubing hanger 111 in the opposite direction is prevented or obstructed.

Figure 9:
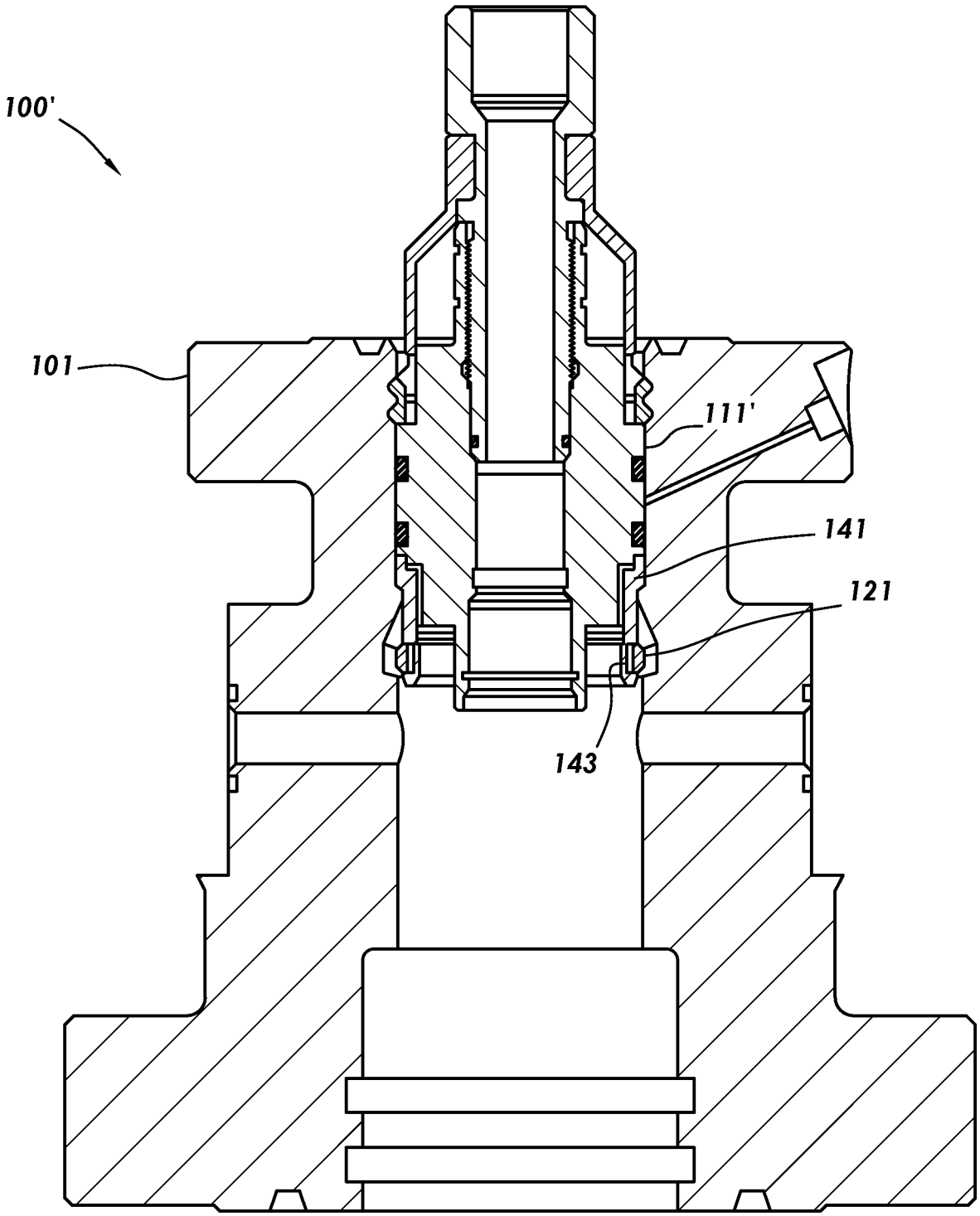
FIG. 9 depicts a cross section view of a wellhead assembly having a wellhead housing and a tubing hanger including an alignment shoulder consistent with at least one embodiment of the present disclosure.
Figure 10:
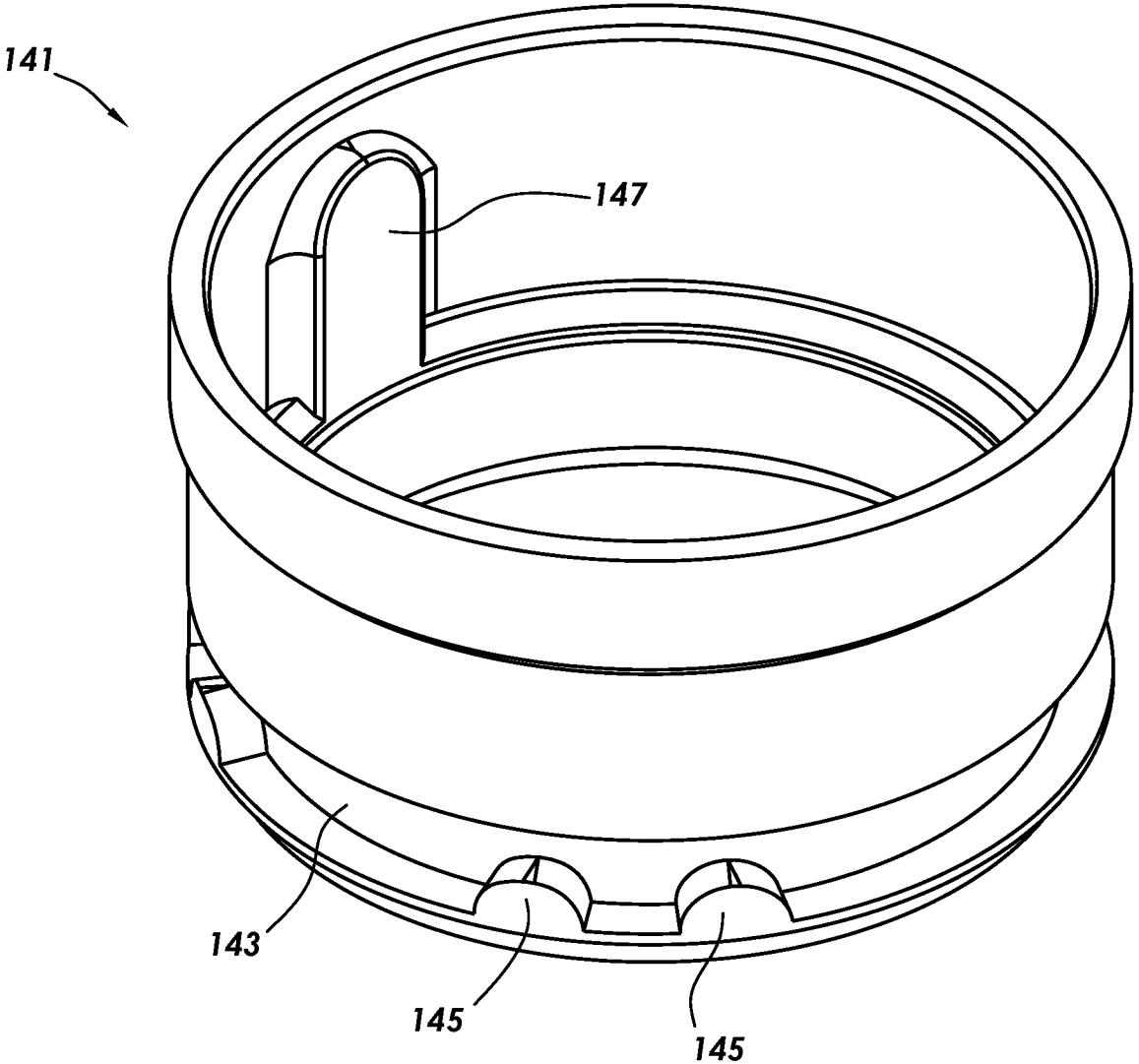
FIG. 10 depicts an alignment shoulder consistent with at least one embodiment of the present disclosure.

In some embodiments, shown as wellhead assembly 100' in FIG. 9, torque ring 121 may be run into wellhead housing 101 on alignment shoulder 141. Alignment shoulder 141 may include slot 143 into which torque ring 121 may be positioned. Slot 143 may include one or more torque transfer features 145 that correspond with torque transfer features 127 of torque ring 121 as discussed herein above with respect to tubing hanger 111 and as depicted in FIG. 10.

In some embodiments, alignment shoulder 141 may include internal alignment feature 147 designed to be engaged by a corresponding feature of a piece of equipment to be inserted into alignment shoulder 141. In some embodiments, internal alignment feature 147 may be a groove, protrusion, flange, or other feature formed in alignment shoulder 141.

In some embodiments, alignment shoulder 141 may be inserted into wellhead housing 101 and protrusions 125 may engage mating grooves 105 as described above. Another piece of equipment, such as tubing hanger 111' as shown in FIG. 9, may be inserted axially into wellhead housing 101 and into engagement with alignment shoulder 141. As alignment shoulder 141 is already seated and prevented or obstructed from rotating relative to wellhead housing 101, tubing hanger 111' may be inserted in a known orientation without additional rotation of tubing hanger 111' being necessary.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A wellhead assembly comprising:

a wellhead housing, the wellhead housing including an inner bore, the wellhead housing having one or more mating grooves formed on an inner wall of the wellhead housing;

a tubing hanger, the tubing hanger positioned within the inner bore of the wellhead housing; and a torque ring, the torque ring positioned within a slot formed in the tubing hanger, the torque ring including a protrusion, the protrusion extending beyond the tubing hanger and into the mating groove;

wherein the torque ring includes a torque transfer feature and the slot of the tubing hanger includes a corresponding torque transfer feature.

2. The wellhead assembly of claim 1, wherein the torque transfer features are matching castellations.

3. The wellhead assembly of claim 1, wherein the torque transfer feature of the torque ring is a semi-circular cutout.

4. The wellhead assembly of claim 1, wherein the mating groove includes a tapered sidewall.

5. The wellhead assembly of claim 1, wherein the mating groove includes a tapered upper wall.

6. The wellhead assembly of claim 1, wherein the torque ring is a split ring.

7. A wellhead assembly comprising:

a wellhead housing, the wellhead housing including an inner bore, the wellhead housing having one or more mating grooves formed on an inner wall of the wellhead housing;

an alignment shoulder, the alignment shoulder positioned within the inner bore of the wellhead housing; and a torque ring, the torque ring positioned within a slot formed in the alignment shoulder, the torque ring including a protrusion, the protrusion extending beyond the alignment shoulder and into the mating groove;

wherein the torque ring includes a torque transfer feature and the slot of the alignment shoulder includes a corresponding torque transfer feature.

8. The wellhead assembly of claim 7, wherein the torque transfer features are matching castellations.

9. The wellhead assembly of claim 7, wherein the torque transfer feature of the torque ring is a semi-circular cutout.

10. The wellhead assembly of claim 7, wherein the torque ring is a split ring.

11. A method comprising:

providing a wellhead housing, the wellhead housing including an inner bore, the wellhead housing having one or more mating grooves formed on an inner wall of the wellhead housing;

positioning a torque ring into a slot formed in a tubing hanger, the torque ring including a protrusion, the protrusion extending beyond the tubing hanger, the torque ring including a torque transfer feature and the slot of the tubing hanger including a corresponding torque transfer feature;

inserting the tubing hanger into the inner bore of the wellhead housing;

engaging the wellhead housing with the protrusion;

deflecting the torque ring inward until the protrusion is within a diameter of the inner bore of the wellhead housing;

aligning the protrusion with the mating groove;

biasing the protrusion radially outward into the mating groove; and preventing rotation of the tubing hanger.

12. The method of claim 11, wherein aligning the protrusion with the mating groove comprises further axially inserting the tubing hanger into the inner bore of the wellhead housing.

13. The method of claim 12, further comprising rotating the tubing hanger until the protrusion is aligned with the mating groove.

14. The method of claim 11, wherein the torque transfer features are matching castellations.

15. The method of claim 11, wherein the torque transfer feature of the torque ring is a semi-circular cutout.

16. A method comprising:

providing a wellhead housing, the wellhead housing including an inner bore, the wellhead housing having one or more mating grooves formed on an inner wall of the wellhead housing;

positioning a torque ring into a slot formed in an alignment shoulder, the torque ring including a protrusion, the protrusion extending beyond the alignment shoulder, the torque ring including a torque transfer feature and the slot of the alignment shoulder including a corresponding torque transfer feature;

inserting the alignment shoulder into the inner bore of the wellhead housing;

engaging the wellhead housing with the protrusion;

deflecting the torque ring inward until the protrusion is within a diameter of the inner bore of the wellhead housing;

aligning the protrusion with the mating groove;

biasing the protrusion radially outward into the mating groove; and preventing rotation of the alignment shoulder.

17. The method of claim 16, further comprising:

inserting a tubing hanger into the alignment shoulder; and preventing rotation of the tubing hanger.

* * * * *